United States Patent [19]

Ganter et al.

[11] 4,037,401

[45] July 26, 1977

[54] APPARATUS FOR ADJUSTING A DATE RING OF A WATCH

[75] Inventors: Wolfgang Ganter; Gunter Scholz, both of Schramberg, Germany

[73] Assignee: Firma Gebruder Junghans GmbH, Germany

[21] Appl. No.: 649,238

[22] Filed: Jan. 15, 1976

[30] Foreign Application Priority Data

Jan. 22, 1975 Germany ..... 2502380

[51] Int. Cl.[2] ..... G04B 19/24

[52] U.S. Cl. ..... 58/58; 58/85.5; 58/4 R

[58] Field of Search ..... 58/4 R, 58, 63, 73, 58/85.5

[56] References Cited

U.S. PATENT DOCUMENTS

| | | | |
|---|---|---|---|
| 3,675,412 | 7/1972 | Mouquin | 58/58 |
| 3,691,756 | 9/1972 | Ono | 58/58 |
| 3,775,966 | 12/1973 | Matsuura | 58/58 |

FOREIGN PATENT DOCUMENTS

| | | | |
|---|---|---|---|
| 372,983 | 12/1963 | Switzerland | 58/58 |

*Primary Examiner*—Ulysses Weldon

*Attorney, Agent, or Firm*—Burns, Doane, Swecker & Mathis

[57] ABSTRACT

A date adjusting mechanism for a timepiece includes a date ring and an operating shaft mounted for axial and rotational displacement. The shaft is axially shiftable into and from a date control position. A date control gear is mounted on the shaft. A correcting gear is continuously connected to the date control gear. The correcting gear is shiftable toward and away from driving engagement with the date ring. A stop lever is rotatably mounted to the frame of the time piece. Linkage is provided for connecting the stop lever to the operating shaft to rotate the stop member into a position blocking movement of the correcting gear into driving engagement with the date ring when the operating shaft is axially displaced from its date control position.

17 Claims, 9 Drawing Figures

Fig. 6
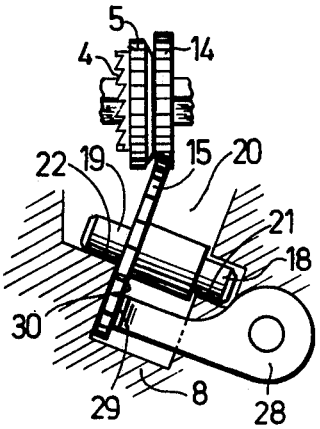
Fig. 4
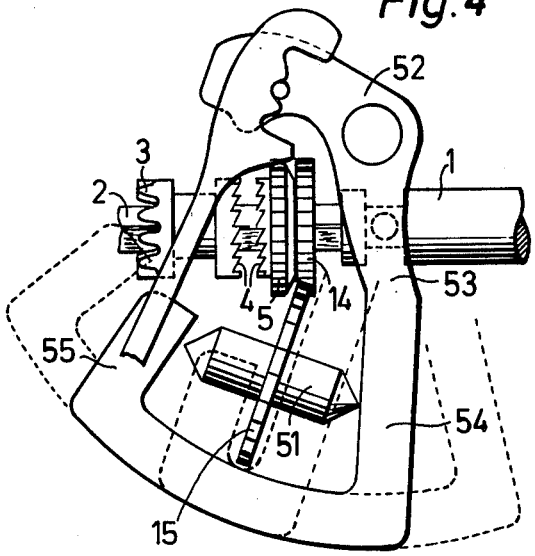
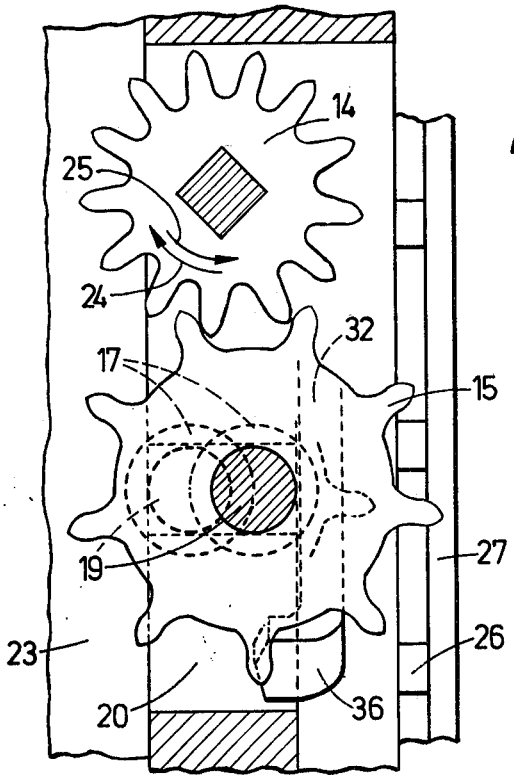
Fig. 5

APPARATUS FOR ADJUSTING A DATE RING OF A WATCH

BACKGROUND AND OBJECTS

The invention relates to a quick correcting arrangement for the date ring of a watch.

A quick correcting arrangement for the date ring of a watch has been disclosed in German published application 2,133,179, the disclosure of which is hereby incorporated by reference. This arrangement can be operated in the spring-winding position of the stem shaft, or in the case of electric wrist watches in the corresponding innermost functionless adjusting position of the adjusting shaft. Since, however, it is not necessary to carry out a correction of the date during every one of the winding processes, the correcting arrangement is brought into driving connection with the date reading only by way of an adjusting mechanism via a trigger placed beside the button. In the case of electric wrist watches, it will be guaranteed in this way that unintentional continued shiftings of the date ring are excluded in the innmost adjusting position of the adjusting shaft.

More particularly, the quick-correcting arrangement of such German published application comprises a correcting gear mounted by a rocker on the winding shaft (in the following pages referred to as operating shaft), on which shaft a drive gear has been mounted. The rotational axis of the correcting gear, just like that of the operating shaft, is perpendicular in relation to the axis of the hands. This correcting gear is in constant engagement with the drive gear arranged on the operating shaft and operated via the stem.

By swiveling the correcting rocker, the latter with its correcting gear can be brought into connection simultaneously with a rotatable rim of the date ring.

A trigger has been provided furthermore which, in the case of axial shifting of the stem, swivels the correcting rocker in the manner mentioned via an additional rocker with an attachment.

For the correction of the date, first of all the trigger must be depressed and then the date must be adjusted correspondingly by twisting the winding stem in the desired direction.

Such a manipulation, in order to accomplish the quick correction of the date, does however not correspond to present-day conceptions. Secondly, this known quick correcting arrangement is also expensive insofar as a drag spring will be necessary in order to make possible a quick correction even in case of a fully wound watch. Furthermore, its use for watertight watches is connected with still an additional expenditure, because there is an additional opening in the housing for the trigger, which opening will also have to be sealed.

Starting out from the previously stated status of the prior art, the invention is based therefore on the main object of finding a quick correcting arrangement for the date of a watch in case of which the correction can be accomplished solely by way of the operating shaft, thereby avoiding the additional expenditures associated with the above-mentioned known correcting arrangement.

SUMMARY OF THE INVENTION

This task, as well as the development of further advantages, is accomplished by the characteristics of the present invention as defined by the appended claims. More particularly, according to the invention a timepiece comprises a date ring and an operating shaft mounted for axial and rotational displacement. The shaft is axially shiftable into and from a date control position. A date control gear is mounted on the shaft. A correcting gear is disposed in continuously connected relationship with the date control gear. The correcting gear is shiftable toward and away from driving engagement with the date ring. A rotatably mounted stop member is connected to the operating shaft so as to be rotated into a position for preventing shifting of the correcting gear into driving engagement with the date ring when the operating shaft is axially displaced from its date control position.

THE DRAWINGS

The invention will be explained in more detail on the basis of a few preferred embodiments by way of example in which:

FIG. 4 is a view of a modified form of the quick correcting arrangement according to the invention in the date adjusting position;

FIG. 5 is a sectional view along the line V—V in FIG. 2 in an enlarged presentation;

FIG. 6 is a view of a modification of the first embodiment of the quick correcting arrangement according to the invention wherein a friction imposing element is provided for the correcting gear;

DETAILED DESCRIPTION

Figure 1:
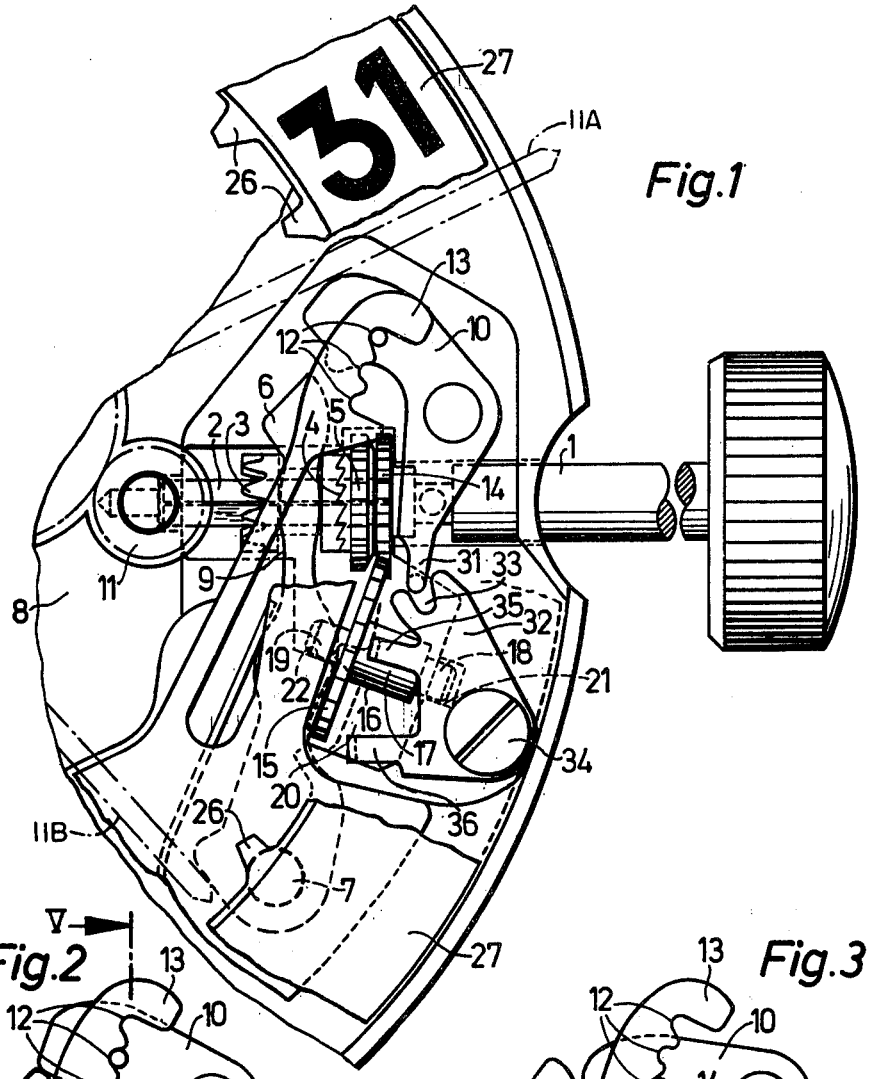
FIG. 1 is a view of the spring winding and hand adjusting mechanism of a wrist watch according to a first embodiment of the quick correcting arrangement according to the invention, with such mechanism being disposed in a spring-winding position.
Figure 2:
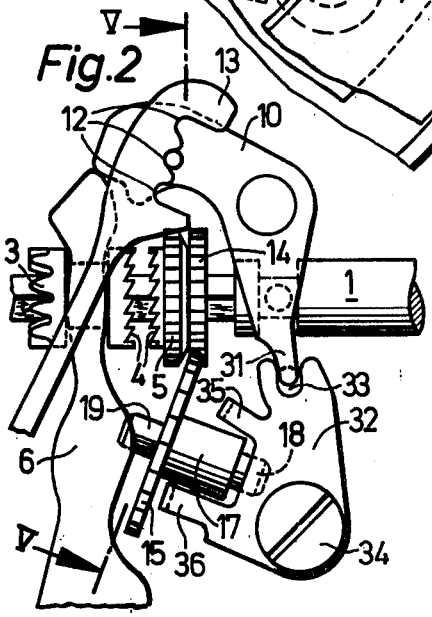
FIG. 2 is a view of the first embodiment of the quick correcting arrangement according to the invention, with the mechanism being disposed in the date correcting position.
Figure 3:
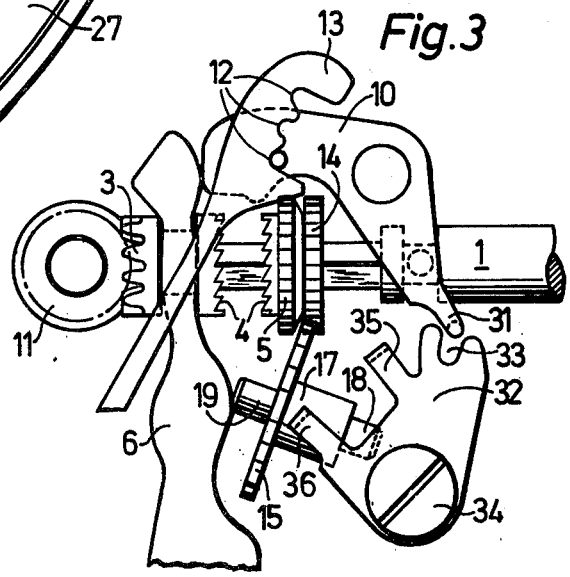
FIG. 3 is a view of the first embodiment of the quick correcting arrangement according to the invention, with the mechanism being disposed in the hand adjusting position.

FIG. 1 shows an arrangement for winding the drive spring and for adjusting the hands or pointers of a watch in connection with the quick date correcting arrangement according to a first embodiment of the present invention. In FIG. 1 the arrangement is positioned in the winding position for the drive spring mechanism. This arrangement can be brought into two further adjusting positions according to FIGS. 2 and 3 by way of axial displacement of a rotatable operating shaft or stem 1. FIG. 2 represents the quick correcting position for the date, and FIG. 3 represents the position for the adjustment of the hands. As is customary, a drive member 3 has been arranged on a square section 2 of the operating shaft 1. The drive member 3 is slidable upon the shaft 1 but is non-rotatable relative thereto. In FIG. 1 the member 3 is shown to engage a spring winding gear 5 by way of a toothing 4 on the member 3, which winding gear 5 is mounted on the operating shaft 1 for rotation relative thereto. The gear 5 meshes with a spring winding wheel (not shown) in a conventional manner. The watch includes a frame plate 8 having a post 7. The numeral 6 designates a coupling lever which is rotatably mounted on the post 7. This lever 6 passes through a groove 9 in the drive member 3, and is swiveled in the customary manner by a pivoted adjusting lever 10, as shown in FIGS. 2 and 3. The adjusting lever 10 is thus operable to slide the drive member 3. The coupling drive 3 can thus be pushed from the FIG. 1 position into an ineffective middle position (FIG. 2) and into a position (FIG. 3) in which it meshes with a conventional adjusting drive gear 11 for the hands 11A, 11B. A spring 13 has grooves 12 for receiving a projection of the adjusting lever 10 to retain the shaft 1 in each of its control positions.

According to the invention, a date control gear 14 is disposed for rotation with the square portion 2 of the operating shaft 1. The gear 14 is completely independent of the drive member 3 or the winding drive gear 5. This gear 14 is in constant engagement with a correcting gear 15, the shaft 16 of which — just like the operating shaft 1 — lies in a plane perpendicular to the shafts of the hands, not shown. The shaft 16 of the correcting gear 15 has an enlargement 17 as well as outwardly projecting pegs 18, 19. The gear 15 lies in a plane at an acute angle to the operating shaft 1 and lies movably in a recess 20 extending through the entire thickness of the frame plate 8. At walls 21 and 22 of the frame plate 8 defining the recess 20, the pegs 18 and 19 have a counter bearing. The recess 20 is limited on one side in the area of the pegs 18, 19 by a winding bridge 23 (FIG. 5).

Thus, the correcting gear 15 can be driven by way of the operating shaft 1 and the adjusting gear 14, whereby in the case of their rotation in the direction 24 (FIG. 5), the correcting gear 15 is shifted by rolling movement along the walls 21, 22 within the recess 20 in the direction of the winding bridge 23 until the pegs 18, 19 abut there, as depicted in FIG. 5, in broken lines.

In the case of rotation of the operating shaft 1 in the direction 25 on the contrary (FIG. 5), the correcting gear 15 is forced toward and against the gear rim 26 of the date ring 27, as depicted by solid lines in FIG. 5.

Both shifting movements of the correcting gear 15 are caused by resulting forces, the components of which develop as a result of the friction of the pegs 18, 19 against the walls 21, 22 of the recess 20 and friction of the engagement of the tooth of the adjusting gear 14 and the correcting gear 15. That is, since the pegs 18, 19 are loosely mounted in the bearing recesses 21, 22, they are free to travel, i.e. roll or slide when gear 14 drives gear 15.

These sliding movements of the gear 15 can also be brought about by frictions produced by a leaf spring 28 which is attached to the frame plate 8. The spring 28 engages the side 29 of the correcting gear 15 facing away from the operating shaft (FIG. 6). The spring 28 forces the gear 15 against a wall 30 of the recess 20.

In order to achieve the goal striven for by this invention, the operating shaft 1 and the shaft 16 of the correcting gear 15 cooperate with a lever arrangement. This arrangement, in one embodiment of the invention, comprises an extension 31 on the adjusting lever 10, and a control lever or stop member 32. The extension 31 engages with a recess 33 of the control lever 32 and is capable of swiveling this lever 32 around a set screw 34 defining a rotary axis for the lever 32. Since the adjusting lever 10 is rotated by axial displacement of the shaft 1, the positioning of the control lever 32 will be dependent upon the axial positioning of the shaft 1. In the case of adjusting positions of the shaft 1 according to FIGS. 1 and 3, always a bent end of one or two control arms 35, 36 of the control lever 32 comes to lie in front of the enlargement 17 of the correcting shaft 16. A shifting of the correcting gear 15 toward the gear rim 26 is thus stopped even though the operating shaft 1 is rotated in the direction 25. If desired, the parts 35, 36 of the lever 32 can be disposed to allow shifting of the correcting gear 15 toward, but short of, the gear rim 26 of the date ring 26. The ends of the control arms are preferably tapered at an obtuse angle.

In the case of the previously described production of friction by the leaf spring 28, the latter can be attached below the control lever 32 by the attachment of a screw 34 on the frame plate 8.

Whenever, on the contrary, the operating shaft 1 is moved into the position according to FIG. 2, then none of the two previously mentioned control arms 35, 36 lies in front of the enlargement 17 of the correcting gear shaft 16. In the case or rotation of the operating shaft 1 in direction 25 therefore, the enlargement 17 can travel between the control arms 35 and 36, whereby the correcting gear 15 comes into engagement with the shifting gear rim 26, and the pegs 18, 19 of the correcting gear shaft 16 come to engage the sides of the control lever 32 and the coupling lever 6 for the purpose of limiting the sliding travel (FIGS. 2 and 5).

It is, naturally, possible to omit any special limitation of the sliding travel of the correcting gear 15 in the direction toward the shifting gear rim 26, since a limitation is inherently brought about by engagement of the base of the teeth of the correcting gear 15 with the teeth of the shifting gear rim.

FIG. 4 shows a modification of the FIGS. 1–3. In this case, the correcting gear 15 has a shaft 51, which at both ends terminates in the form of a cone. The shaft 51 can be guided for travel within the frame plate 8 in the same way as has been described already in the cases of FIGS. 1–3. For the purpose of controlling the correcting gear 15, there is in this case, an elongated extension 53 of the adjusting lever, now designated by numeral 52. The extension 53 constitutes a control lever which encircles, in a U-shaped manner, the correcting gear 15 by means of integral control arms 54 and 55. In the date correcting position shown in FIG. 4, the correcting gear 15 is not impeded by the U-shape of the extension 53 of the adjusting lever, and can travel toward the shifting gear rim 26 of the date ring (no longer shown).

In the spring-winding position and in the position for the adjustment of the hands, the arms 54, 55 prevent or limit travel of the gear 15 (see the broken line positions of the arms in FIG. 4). That is, in the spring-winding position the arm 54 moves in front of the shaft 51, and in the hand adjusting position the arm 55 moves in front of the shaft 51 to prevent driving engagement between the gear 15 and the gear rim 26.

Figure 7:
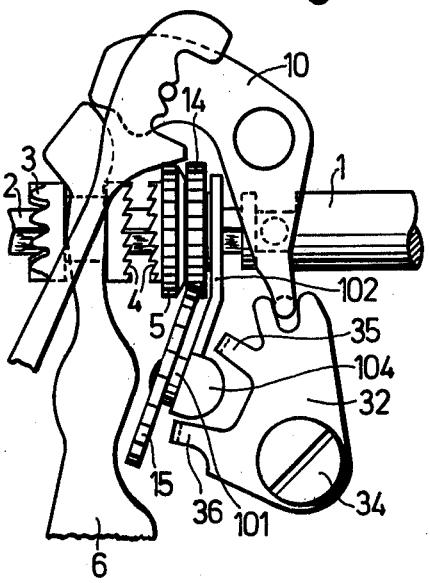
FIG. 7 is a view of another modified form of quick correcting arrangement according to the invention in the date-correcting position.
Figure 8:
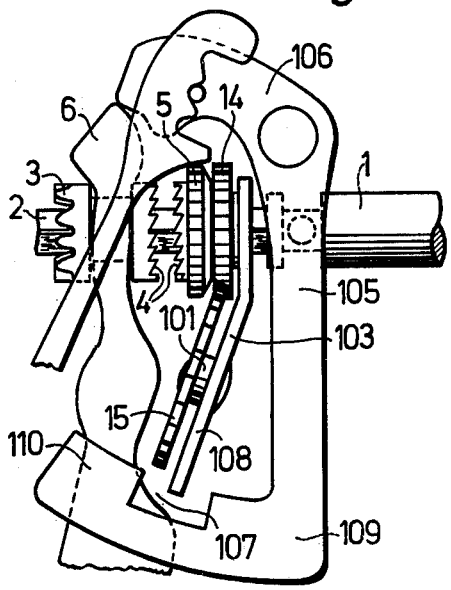
FIG. 8 is a further modified form of quick correcting arrangement according to the invention in the date-correcting position.

FIGS. 7 and 8 show a second embodiment of the invention. FIG. 7 basically corresponds to FIG. 2, and FIG. 8 to FIG. 4. The only difference as compared to FIGS. 2 and 4 is the fact that, as has been known from the previously mentioned German published application, the correcting gear 15 is mounted on a rocker 102 (FIG. 7) or 103 (FIG. 8) by means of a shaft 101. These rockers are disposed swivelably on the operating shaft 1. In the case of use of such a rocker, guidance of the correcting gear in the recess 20 is omitted. The advantages of the present invention may be had in conjunction with the arrangement of rockers according to the above mentioned German published application. Instead of the enlargement 17 of the correcting gear shaft 16 according to FIGS. 1–3, the rocker 102 has a boss 104 for the control of the rocker and the correcting gear 15. This flap cooperates with control arms 35, 36 of the control lever 32 (FIG. 7).

According to FIG. 8, the control of the rocker 103 will be achieved by means of an extension 105 of a control lever 106.

The extension 105 for this purpose has a recess 107 into which the free end 108 of the rocker 103 can enter in the correcting position of the adjusting lever 106, as shown. Thus, the correcting gear 15 can engage the shifting gear rim of the date ring (no longer shown in this embodiment). In the spring-winding position and in the hand-adjusting position of the operating shaft, two control arms 109, 110 of the adjusting lever extension 105 will, on the contrary, prevent a swinging-up of the rocker 103.

As can be seen from FIG. 5, the pitch of the teeth of the correcting gear 15 has been adapted to the toothing 26 for shifting the date ring 27. Also, the correcting gear 15 always remains coupled to the gear 14. The adjusting gear 14, as compared to the correcting gear 15, has twice as many teeth with half the pitch of the teeth. In this manner — as becomes clear already from the description hitherto — the engagement of the correcting gear can take place directly with the shifting gear rim, which is present in any case. A special toothing on the date ring therefore is not necessary, as has been necessary in the case of the German published application previously discussed.

The embodiments described thusfar have involved correction of the date in the second adjusting position of the operating shaft and the adjustment of the hands in the third position. However, according to the invention it is basically possible to also carry out the adjustment of the hands in the second adjusting position of the operating shaft. That is, as becomes clear from the description up to this point, only a turn of the operating shaft in direction 25 (FIG. 5) will be effective for the quick correction. The counter rotational direction 24 is without effect on the date reading and it could therefore be utilized for the adjustment of the hands.

Figure 9:
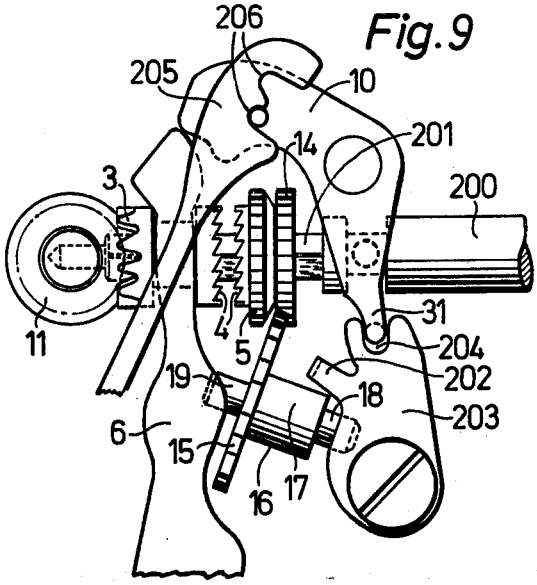
FIG. 9 is a view of an additional modified form of quick correcting arrangement according to the invention in a hand/date adjusting position.

FIG. 9, as a modification of the embodiment of FIGS. 1–3, shows such an embodiment of the invention, whereby the operating shaft designated in this case by the numeral 200 is located in the second adjusting position in which, as had been explained previously, the adjustment of the hands can also be carried out as well as the quick correction of the date.

In order that an engagement of the coupling drive member 3 with the adjusting drive 11 for the hands should take place already in this adjusting position of the operating shaft 200, it will be necessary that its square portion 201, as can be seen from FIG. 9 be correspondingly shorter, and also that the adjusting drive 11 for the hands should be connected so as to adjust the hands only in the rotational direction 24 of the operating shaft.

It is clear furthermore from FIG. 9 that in the position of the operating shaft 200 as shown, the enlargement 17 of the correcting gear 15 is not blocked by the control arm 202 of the control lever 203. Therefore, as has already been described in FIGS. 1–3, the correcting gear in case of a rotation in direction 25 can engage with the shifting gear rim 26 of the date ring 27 (not shown here).

In this embodiment (FIG. 9) the adjusting lever 10, with its extension 31, engages within a recess 204 of the control lever 203. Whenever the operating shaft 200 is pushed into the winding position, the control lever 203 therefore swivels and the control arm 202 comes to lie in front of the enlargement 17 of the correcting gear shaft 16. As a result, any engagement of the correcting gear 15 with the shifting gear rim 26 is prevented.

Consequently, the spring 205 of the adjusting lever has only two notches 206 for receiving the projection of the adjusting lever 10.

By virtue of the present invention, the date ring of a timepiece can be adjusted by means of the operating shaft, thereby avoiding the need for a separate triggering mechanism. Moreover, this arrangement enables mechanism to be provided for adjusting either the hands or the date ring for a single given position of the operating shaft (FIG. 9). That is, it is only required to shift the operating shaft between two positions, rather than three. The novel arrangement which provides these expedients requires only minor modification of conventional watches and avoids the need for relatively complicated linkages which might require the positioning of additional holes in the outer housing of the watch.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a timepiece having a drive spring; indicator hands; a date ring; an operating shaft arranged for winding said spring, adjusting said hands, and adjusting said date ring; a date control gear on said shaft; a correcting gear having a correcting gear shaft and being in continuous engagement with said date control gear, said correcting gear being shiftable into driving connection with said date ring; and an adjusting lever for releasably retaining said operating shaft in control positions for winding said spring, adjusting said hands, and adjusting said date ring, the improvement wherein:

said date control gear is slidable and non-rotatable relative to said operating shaft;

said date control gear operates independently of winding of said spring and adjusting of said hands;

said correcting gear being mounted for rolling movement along a stationary wall toward said date ring in response to being rotated in a selected direction by said control gear; and control lever means being operably connected to said operating shaft for being shifted relative to said correcting gear in response to movement of said shaft between said control positions;

said control lever having a stop portion disposed in the path of travel of said correcting gear toward said date ring when said operating shaft is at least in a position for winding said spring, to prevent shifting of said correcting gear into driving relationship with said date ring;

said stop portion being disposed out of the path of travel of said correcting gear toward said date ring when said operating shaft is in a date adjusting position to permit shifting of said correcting gear into driving relationship with said date ring.

2. A timepiece according to claim 1 including a frame plate, said correcting gear shaft being mounted for radial travelling movement in a recess of said frame plate.

3. A timepiece according to claim 1 wherein said control lever means is rotatably mounted and includes at least one control arm which constitutes said stop portion; an adjusting lever having an extension received within a recess of said control lever; said adjusting lever being drivingly connected to said operating shaft to rotate said control lever in response to axial displacement of said operating shaft.

4. A timepiece according to claim 3 wherein the rotational axis of said control lever lies perpendicularly in relation to said correcting gear shaft.

5. A timepiece according to claim 1 wherein said control lever comprises an extension of an adjusting lever which is pivotably mounted and rotated by axial displacement of said operating shaft.

6. A timepiece according to claim 1 wherein said correcting gear shaft has an enlargement which is selectively blocked by said stop portion.

7. A timepiece according to claim 1 wherein said correcting gear shaft has cone-shaped ends which are selectively blocked by said stop portion.

8. A timepiece according to claim 2 further including a wheel axially movable on said operating shaft and rotatable for adjusting said hands; a coupling lever mounted to transmit axial movement to said wheel in response to axial displacement of said operating shaft; said correcting gear including a pair of co-axial pegs which are arranged to roll in said recess; one end of said recess being continuously enclosed by a winding bridge lying in the path of said pegs, another end of said recess being continuously enclosed by said coupling lever lying in the path of one of said pegs and by said control lever means lying in the path of the other peg.

9. A timepiece according to claim 2 wherein with said control lever means being disposed to allow said movement of said correcting gear, the path of said correcting gear shaft is limited in said recess by a winding bridge at one recess end and by a rim of said date ring at the other recess end.

10. A timepiece according to claim 1 including a hand-adjusting wheel drivingly connected to said operating shaft, means for moving said wheel into a hand-adjusting position in response to axial displacement of said operating shaft to a position permitting shifting of said correcting gear into driving relationship with said date ring, such that in said last-named position of said shaft, rotation of said operating shaft in one direction adjusts said hands and rotation of said operating shaft in the other direction adjusts said date ring.

11. A timepiece according to claim 10 wherein said date control gear and said correcting gear have teeth, the pitch of the teeth of said date control gear being half as great as the teeth of said correcting gear.

12. A timepiece according to claim 1, including a leaf spring arranged to impose frictional forces against said correcting gear to produce shifting of said correcting gear in response to said correcting gear being rotated by said date control gear.

13. A date adjusting mechanism for a timepiece comprising:

a date ring;

an operating shaft mounted for axial and rotational displacement;

said shaft being axially shiftable into and from a date control position;

a date control gear on said shaft;

a correcting gear continuously connected to said date control gear;

said correcting gear being mounted for rolling movement along a stationary wall toward and away from driving engagement with said date ring in response to being rotated in a selected direction by said control gear;

a movably mounted stop member; and means connecting said stop member to said operating shaft to move said stop member into a position blocking shifting movement of said correcting gear into said driving engagement, when said operating shaft is axially displaced from said date control position.

14. In a timepiece having a drive spring; indicator hands; a date ring; an operating shaft arranged for winding said spring, adjusting said hands, and adjusting said date ring; a date control gear on said shaft; a correcting gear having a correcting gear shaft and being in continuous engagement with said date control gear, said correcting gear being shiftable into driving connection with said date ring; and an adjusting lever for releasably retaining said operating shaft in control positions for winding said spring, adjusting said hands, and adjusting said date ring, the improvement wherein:

said date control gear is slidable and non-rotatable relative to said operating shaft;

said date control gear operates independently of winding of said spring and adjusting of said hands;

a rocker arm is mounted on said operating shaft, said correcting gear shaft being mounted on said rocker arm;

control lever means is operably connected to said operating shaft and being shifted relative to said correcting gear in response to movement of said shaft between said control positions;

said control lever having a stop portion disposed to prevent shifting of said correcting gear into driving relationship with said date ring when said operating shaft is at least in a position for winding said spring;

said stop portion being disposed to permit shifting of said correcting gear into driving relationship with said date ring when said operating shaft is in a date adjusting position.

15. A timepiece according to claim 14 wherein said rocker arm has a boss which is selectively blocked by said stop portion.

16. A timepiece according to claim 14 wherein said rocker arm has a free end which is selectively blocked by said stop portion.

17. In a timepiece having a drive spring; indicator hands; a date ring; an operating shaft arranged for winding said spring, adjusting said hands, and adjusting said date ring; a date control gear on said shaft, a correcting gear having a correcting gear shaft and being in continuous engagement with said date control gear, said correcting gear being shiftable into driving connection with said date ring; and an adjusting lever for releasably retaining said operating shaft in control positions for winding said spring, adjusting said hands, and adjusting said date ring, the improvement wherein:

said date control gear is slidable and non-rotatable relative to said operating shaft;

said date control gear operates independently of winding of said spring and adjusting of said hands;

control lever means is operably connected to said operating shaft for being shifted relative to said correcting gear in response to movement of said shaft between said control positions;

said control lever having a stop portion disposed to prevent shifting of said correcting gear into driving relationship with said date ring when said operating shaft is at least in a position for winding said spring;

said stop portion being disposed to permit shifting of said correcting gear into driving relationship with said date ring when said operating shaft is in a date adjusting position;

a hand-adjusting wheel drivingly connected to said operating shaft; and means for moving said wheel into a hand-adjusting position in response to axial displacement of said operating shaft to a position permitting shifting of said correcting gear into driving relationship with said date ring, such that in said last-named position of said shaft, rotation of said operating shaft in one direction adjusts said hands and rotation of said operating shaft in the other direction adjusts said date ring.

* * * * *